US007149450B2

(12) United States Patent
Takemura

(10) Patent No.: US 7,149,450 B2
(45) Date of Patent: Dec. 12, 2006

(54) IMAGE FORMING APPARATUS AND FUNCTION EXTENSION PROGRAM FOR IMAGE FORMING APPARATUS

(75) Inventor: Minoru Takemura, Sagamihara (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 178 days.

(21) Appl. No.: 10/867,763

(22) Filed: Jun. 16, 2004

(65) Prior Publication Data

US 2005/0047812 A1 Mar. 3, 2005

(30) Foreign Application Priority Data

Jul. 7, 2003 (JP) ..... 2003-193125

(51) Int. Cl.
*G03G 15/00* (2006.01)

(52) U.S. Cl. ..... 399/75; 399/42; 399/80; 399/81

(58) Field of Classification Search ..... 399/9, 399/11, 42, 75, 77, 79, 80, 81, 366; 347/41; 358/1.15
See application file for complete search history.

(56) References Cited

U.S. PATENT DOCUMENTS 5,325,209 A * 6/1994 Manabe ..... 358/437
6,862,103 B1 * 3/2005 Miura et al. ..... 358/1.15
6,912,059 B1 * 6/2005 Takahashi ..... 358/1.15
6,991,316 B1 * 1/2006 Maru et al. ..... 347/41
2003/0231343 A1 * 12/2003 Kobayashi et al. ..... 358/1.16

FOREIGN PATENT DOCUMENTS

JP 9-267538 A 10/1997
JP 2001-309099 A 11/2001

* cited by examiner

*Primary Examiner*—Hoan Tran
(74) *Attorney, Agent, or Firm*—Foley & Lardner LLP

(57) ABSTRACT

An image forming apparatus that allows easy implementation of options or other extensions to a multi-functional peripheral or the like is provided, together with a function extension program for use in the image forming apparatus. The image forming apparatus reads a predetermined function program from a storage section storing at least one function program on which usage restrictions have previously been placed and enables the read function program. It is detected whether or not a cancellation device (2, 3 or 4) that cancels the usage restrictions on the at least one function program is connected to a hot-pluggable connecting terminal. Cancellation information is read from the cancellation device when the cancellation device is detected being connected to the connecting terminal. The usage restrictions on the at least one function program are canceled according to the read cancellation information.

15 Claims, 4 Drawing Sheets

Fig. 3

| Hardware keys | Printer function | Scanner function |
|---|---|---|
| Printer function restriction cancellation key | ○ | × |
| Scanner function restriction cancellation key | × | ○ |
| Printer function restriction cancellation key + Scanner function restriction cancellation key | ○ | ○ |
| Printer/scanner function restriction cancellation key | ○ | ○ |

○ : Enable function
× : Not enable function

IMAGE FORMING APPARATUS AND FUNCTION EXTENSION PROGRAM FOR IMAGE FORMING APPARATUS

BACKGROUND OF THE INVENTION

1. Field of the Invention

The present invention relates to an image forming apparatus that forms an image by reading an original image. More particularly, the present invention relates to an image forming apparatus that allows function extension to be achieved easily at reduced cost, and also relates to a function extension program for use in the image forming apparatus.

2. Description of the Related Art

Conventionally, options or other extensions to multi-functional peripherals are implemented by adding hardware devices afterward.

However, it is not easy to add a hardware device each time function extension is made as stated above. This also causes an increase in cost.

Thus, implementation of options or other extensions to multi-functional peripherals suffers from the problem that it is not easy to add a hardware device each time function extension is made.

SUMMARY OF THE INVENTION

Accordingly, it is an object of the present invention to provide an image forming apparatus that allows easy implementation of options or other extensions to a multi-functional peripheral or the like, and also provide a function extension program for use in the image forming apparatus.

To attain the above-described object, the present invention provides an image forming apparatus that forms an image by reading an original image. The image forming apparatus includes a storage section that stores at least one function program for function extension in the image forming apparatus. A restricting section places usage restrictions on the at least one function program. The image forming apparatus further includes a hot-pluggable connecting terminal connectable with a cancellation device that cancels the usage restrictions on the at least one function program. A detecting section detects whether or not the cancellation device is connected to the connecting terminal. A read section reads cancellation information from the cancellation device when the cancellation device is detected being connected to the connecting terminal by the detecting section. A cancellation section cancels the usage restrictions on the at least one function program according to the cancellation information read by the read section. A control section controls the operation of equipment relevant to the at least one function program by using the program released from the usage restrictions by the cancellation section.

In this case, the image forming apparatus may further include a display section that displays the extended function of the at least one function program released from the usage restrictions by the cancellation section. Further, the image forming apparatus may include a display section that displays whether or not the cancellation device is connected to the connecting terminal. Further, the image forming apparatus may include a disabling section that disables the usage of the at least one function program released from the usage restrictions by the cancellation section when it is judged that the cancellation device connected to the connecting terminal is disconnected therefrom. Preferably, the detecting section detects at every predetermined timing whether or not the cancellation device is connected to the connecting terminal. Further, the image forming apparatus may include an identification information judging section that judges whether or not to cancel the usage restrictions on the at least one function program on the basis of identification information acquired from the cancellation device.

In addition, the present invention provides a function extension program for use in an image forming apparatus that instructs a computer of the image forming apparatus to execute reading a predetermined function program from a storage section storing at least one function program on which usage restrictions have previously been placed and enabling the read function program. The function extension program instructs the computer to execute the following steps: a detecting step of detecting whether or not a cancellation device that cancels the usage restrictions on the at least one function program is connected to a hot-pluggable connecting terminal; a read step of reading cancellation information from the cancellation device when the cancellation device is detected being connected to the connecting terminal at the detecting step; and a cancellation step of canceling the usage restrictions on the at least one function program according to the cancellation information read at the read step.

The function extension program may further instruct the computer to execute a control step of controlling the operation of equipment relevant to the at least one function program by using the program released from the usage restrictions at the cancellation step. The function extension program may further instruct the computer to execute a display step of displaying the extended function of the at least one function program released from the usage restrictions at the cancellation step. Further, the function extension program may instruct the computer to execute a display step of displaying whether or not the cancellation device is connected to the connecting terminal. Alternatively, the function extension program may have a judging step of judging whether or not the cancellation device connected to the connecting terminal is disconnected therefrom. In this case, the function extension program may further instruct the computer to execute a disabling step of disabling the usage of the at least one function program released from the usage restrictions at the cancellation step when it is judged that the cancellation device connected to the connecting terminal is disconnected therefrom. Preferably, the detecting step is executed by the computer at every predetermined timing. Further, the function extension program may have an identification information judging step of judging whether or not to cancel the usage restrictions on the at least one function program on the basis of identification information acquired from the cancellation device.

DESCRIPTION OF THE DRAWINGS

FIG. 3 is a diagram for explaining the functions of enablers.

DESCRIPTION OF THE PREFERRED EMBODIMENTS

An embodiment of the present invention will be described below with reference to the accompanying drawings.

Figure 1:
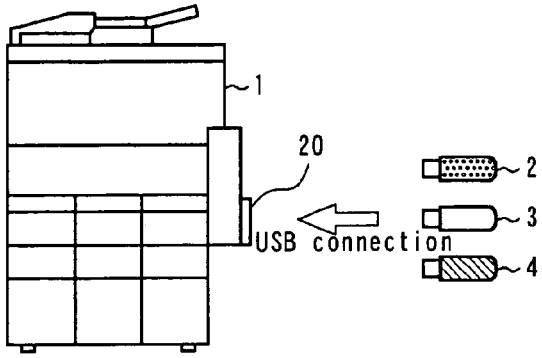
FIG. 1 is a diagram schematically showing the arrangement of an image forming apparatus according to an embodiment of the present invention.

FIG. 1 schematically shows the arrangement of an image forming apparatus according to the present invention.

A multi-functional peripheral (hereinafter abbreviated as "MFP") 1 has a USB (Universal Serial Bus) interface 20.

Meanwhile, there are prepared enablers 2, 3 and 4 that are to be plugged (connected) into the USB interface 20.

The enablers 2, 3 and 4 are hardware keys each comprising a flash memory having an interface for USB port. It should be noted that the interface for USB port is hot-pluggable. For example, if an enabler (2, 3 or 4) is plugged (connected) into the USB interface 20 or unplugged therefrom when the MFP 1 is in use, no influence is exerted on the operation of the MFP 1.

Figure 2:
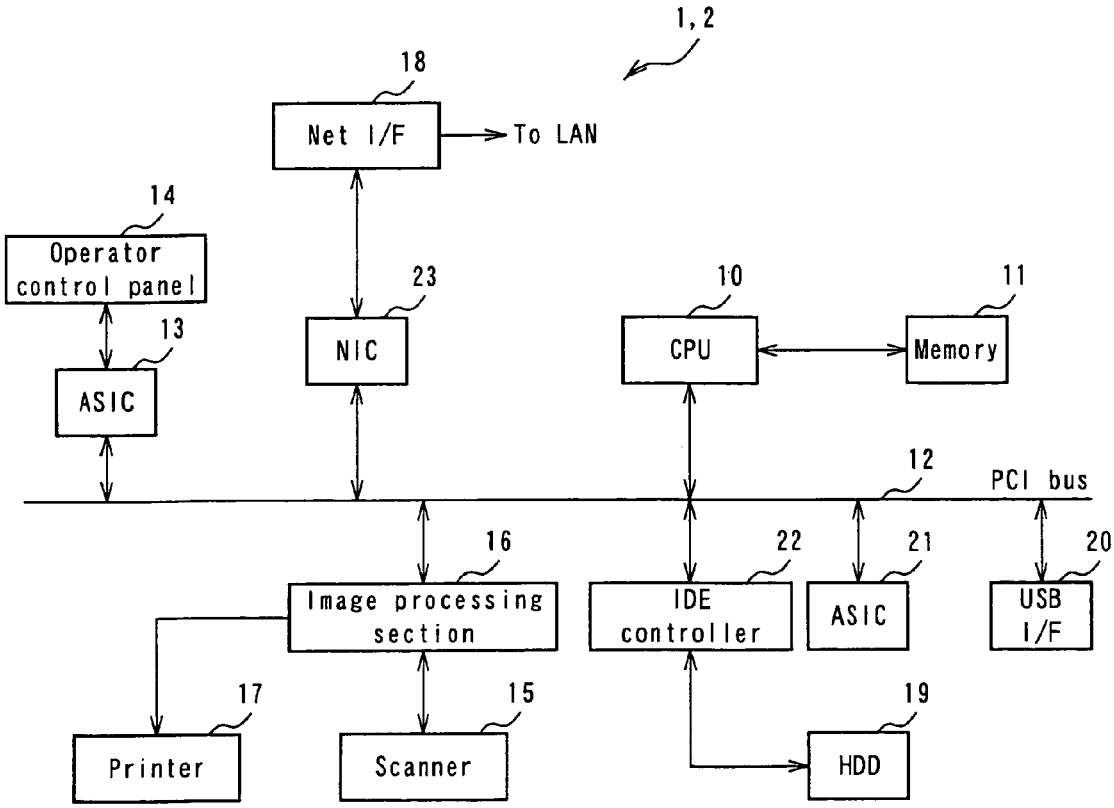
FIG. 2 is a block diagram schematically showing the arrangement of a multi-functional peripheral.

FIG. 2 schematically shows the arrangement of the MFP 1.

That is, a CPU 10 controls the whole MFP 1 and has a memory 11 in which a function extension program for enabling options, etc. has previously been stored. The CPU 10 is connected to a PCI bus 12.

An operator control panel 14 on which a control input operation is performed is connected to the PCI bus 12 through an ASIC 13.

A scanner 15 that reads an original image is connected to an image processing section 16.

The image processing section 16 performs image processing on image data sent from the scanner 15. Further, the image processing section 16 transmits print data subjected to image processing to a printer 17 connected thereto.

The printer 17 prints out the print data.

A net interface (I/F) 18 is connected to the PCI bus 12 through a NIC 23. The net interface 18 connects together a LAN (not shown) and the PCI bus 12.

A hard disk drive (HDD) 19 is connected to the PCI bus 12 through an IDE controller 22 to store print data sent through the NIC 23 and the PCI bus 12.

A USB interface (I/F) 20 is connected to the PCI bus 12 through an ASIC 21.

It should be noted that the PCI bus 12 connects together the CPU 10, the operator control panel 14, the image processing section 16, the HDD 19, and the USB I/F 20, as stated above.

In the memory 11, option programs such as printer and scanner function programs have previously been stored. These function programs have previously been restricted in usage by the main control program stored in the memory 11. In other words, the function programs cannot be read and enabled freely unless the associated enablers (described later) are plugged into the USB interface 20.

FIG. 3 explains the functions of the enablers 2, 3 and 4. For example, when the enabler 2 is plugged (connected) into the USB interface 20 of the MFP 1, it is used as a hardware key that cancels the printer function restrictions. That is, the internal storage sections of the enablers 2, 3 and 4 contain cancellation codes for canceling the use restrictions on the respective function programs.

When the enabler 3 is plugged (connected) into the USB interface 20 of the MFP 1, it is used as a hardware key that cancels the scanner function restrictions.

When the enabler 4 is plugged (connected) into the USB interface 20 of the MFP 1, it is used as a hardware key that cancels both the printer function restrictions and the scanner function restrictions.

It should be noted that the enablers 2, 3 and 4 have different body colors so as to allow distinction between the functions of the cancellation codes stored in the respective enablers 2, 3 and 4.

Next, a function extension operation for adding a printer function, a scanner function, etc. to the MFP 1 with the above-described arrangement will be described with reference to the flowchart of FIG. 4.

First, the CPU 10 of the MFP 1 judges whether or not any of the enablers 2, 3 and 4 is connected to the USB interface 20 (ST1).

If none of the enablers 2, 3 and 4 are connected to the USB interface 20 (if NO at ST1), the CPU 10 terminates the processing without extending either of the printer and scanner functions (ST9). If these functions have already been enabled, the CPU 10 restricts the usage of the functions (disables the usage thereof) and then terminates the processing.

If at least one of the enablers 2, 3 and 4 is detected being connected to the USB interface 20 at step ST1 (if YES at ST1), the CPU 10 reads the cancellation code of the enabler connected to the USB interface 20 (ST2).

If the read cancellation code includes a printer function restriction cancellation code (if YES at ST3), the CPU 10 cancels the printer function restrictions stored in the memory 11 (enables the printer function) (ST4). If the printer function restrictions have already been canceled, the canceled state is maintained. If it is judged at step ST3 that the read cancellation code does not include the printer function restriction cancellation code, the CPU 10 does not perform printer function extension. If the printer function has already been enabled, the CPU 10 restricts the printer function (disables the usage thereof) and then proceeds to step ST6.

If the cancellation code read at step ST2 includes a scanner function restriction cancellation code (if YES at ST6), the CPU 10 cancels the scanner function restrictions stored in the memory 11 (enables the scanner function) (ST7). If the scanner function restrictions have already been canceled, the canceled state is maintained. If it is judged at step ST6 that the read cancellation code does not include the scanner function restriction cancellation code, the CPU 10 does not perform scanner function extension. If the scanner function has already been enabled, the CPU 10 restricts the scanner function (disables the usage thereof) and then terminates the processing.

As has been stated above, if the enabler 2 is detected being connected at step ST1, the printer function restrictions stored in the memory 11 are canceled. If the enabler 3 is detected being connected at step ST1, the scanner function restrictions stored in the memory 11 are canceled. If the enabler 4 is detected being connected at step ST1, both the printer function restrictions and the scanner function restrictions stored in the memory 11 are canceled.

Further, the CPU 10 displays on the operator control panel 14 whether the cancellation code read from the connected enabler 2, 3 or 4 is "printer function ON", "scanner function ON", or "printer function ON and scanner function ON".

Further, the CPU 10 displays on the operator control panel 14 whether or not any of the enablers 2, 3 and 4 is connected to the USB interface 20.

Further, the CPU 10 checks whether or not any of the enablers 2, 3 and 4 is connected to the USB interface 20 at timing determined by the control program. The connection detection timing may be set as desired. For examples, connection detection may be performed when the power supply is turned ON, or every print job, or every printing sheet. By virtue of detecting the connection of an enabler periodically (at every predetermined timing) as stated above, if an enabler is unplugged when the MFP 1 is ON, the relevant extended function is disabled again.

It should be noted that the MFP 1 may be arranged to perform authentication in addition to reading of cancellation codes to decide whether to authorize or unauthorize the usage of each individual enabler so that any function restrictions cannot be canceled with an enabler for use with a different model of MFP even if it is connected to the USB interface 20. In this case, identification information is stored in each of the enablers 2, 3 and 4, and the MFP 1 is provided with an identification information judging section that can perform authentication based on usage authorization identification information registered previously.

Figure 4:
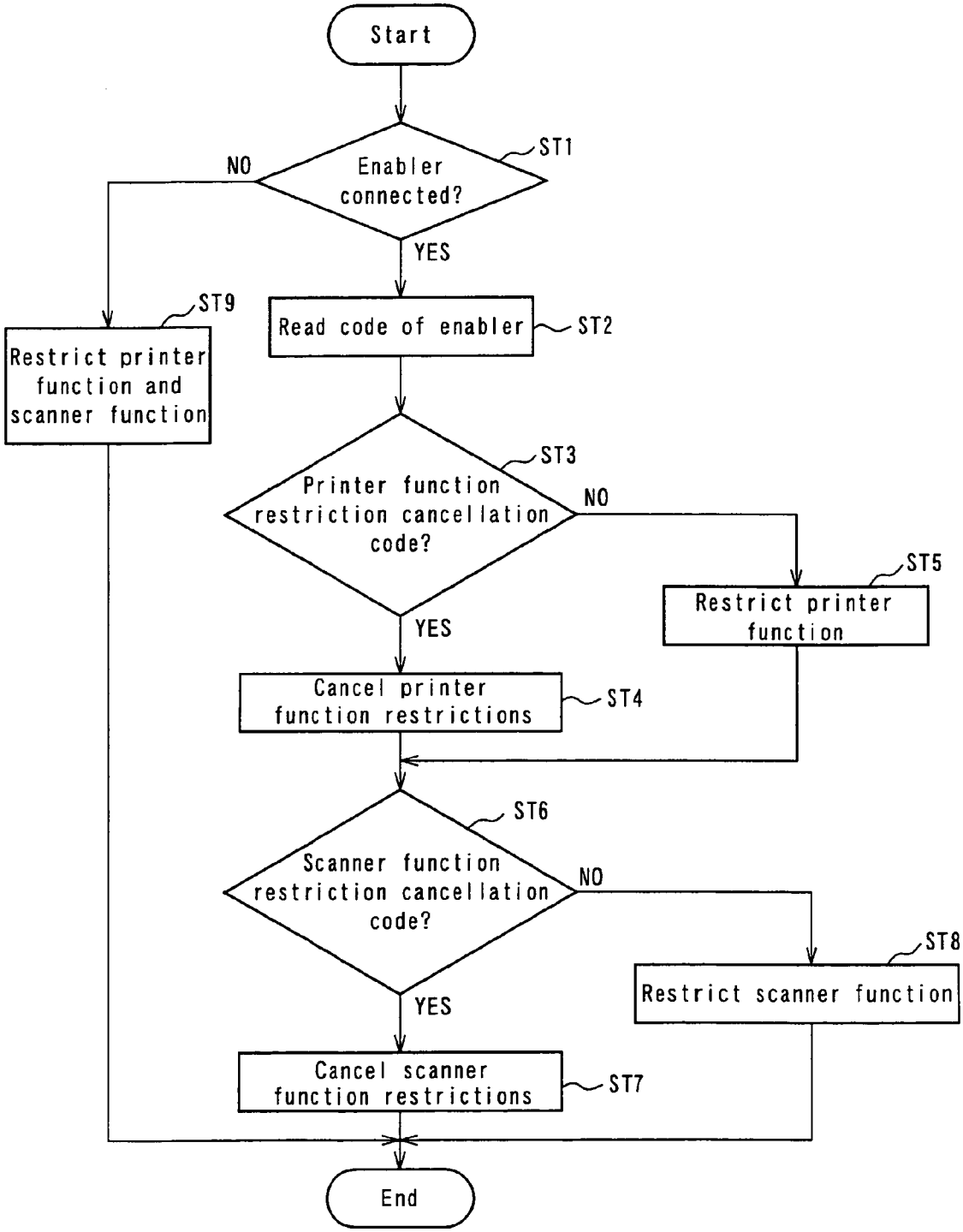
FIG. 4 is a flowchart for explaining a function extension operation for adding a printer function, a scanner function, etc. to the multi-functional peripheral.
Figure 5:
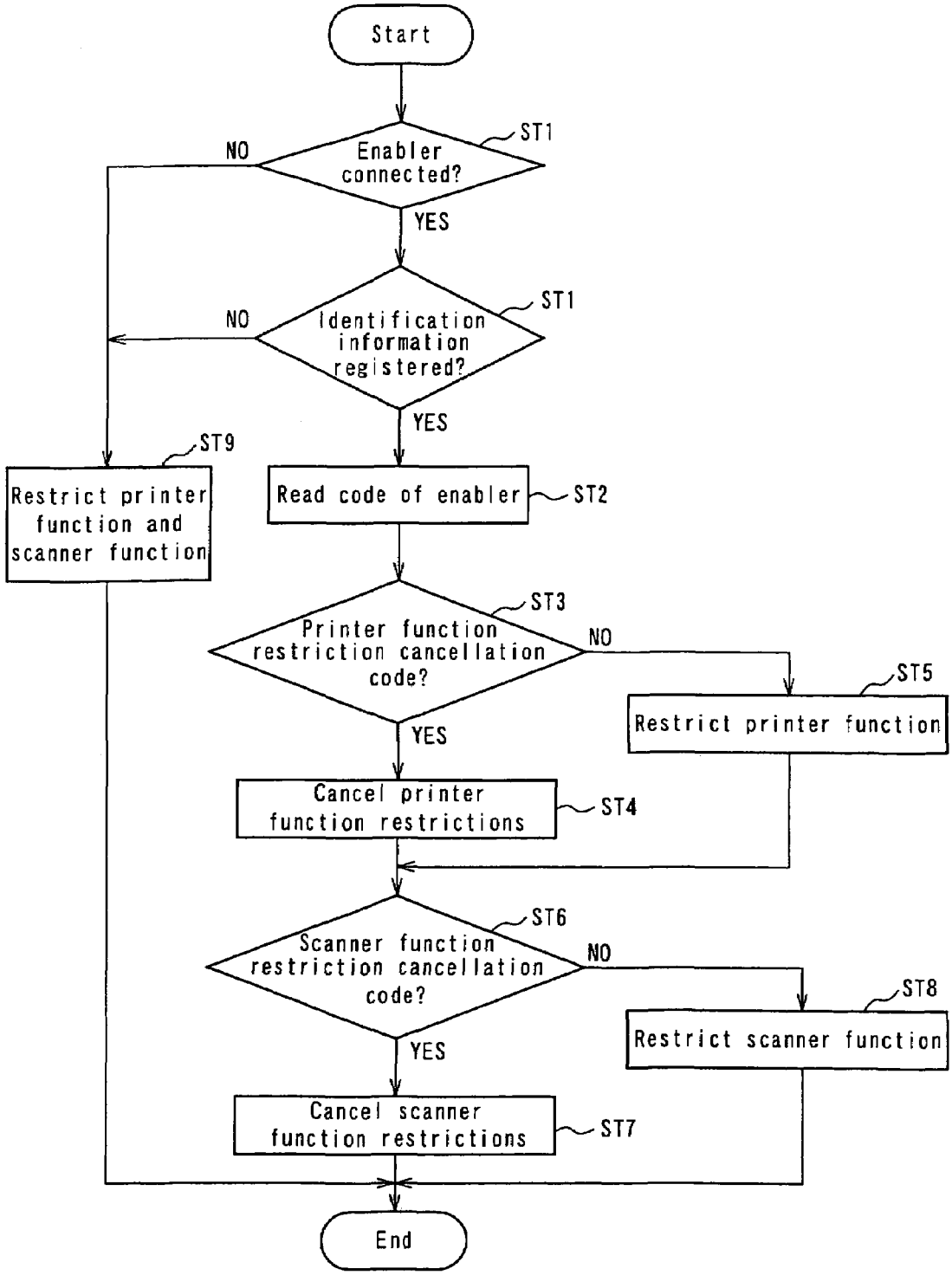
FIG. 5 is a flowchart showing another example of the operation illustrated in FIG. 4.

According to the above-described arrangement, the flowchart of FIG. 4 is modified as shown in FIG. 5, by way of example. That is, step ST1' is provided to judge whether or not identification information concerning an enabler detected being connected is registered identification information. If it is not registered identification information, the CPU 10 proceeds to step ST9. Step ST1' may be carried out at the same time as a judgment is made as to whether or not the read cancellation code includes a function restriction cancellation code (ST3 or ST6). Thus, license management can also be performed by preventing the use of the enablers in a plurality of different systems (MFPs) as stated above.

As has been stated above, according to the foregoing embodiment, option programs for extensions to an MFP that are restricted in usage are stored in a memory in advance, and a desired function is released from the restrictions (enabled) by connecting an enabler to the MFP. Thus, function extension can be achieved easily.

Further, it is periodically detected whether or not an enabler is connected to the MFP. Therefore, if an enabler is unplugged from the MFP, the usage of the extended function is disabled. Thus, unauthorized usage of the function can be prevented.

It should be noted that the present invention is applicable not only to MFPs but also to printers.

In the foregoing embodiment, the present invention has been described with regard to an example in which a function (program) for carrying out the invention has previously been recorded in the image forming apparatus. However, the present invention is not necessarily limited thereto. A similar function may be downloaded into the apparatus from a network. A storage medium storing a similar function may be installed in the apparatus. The storage medium may take any form, e.g. a CD-ROM device, provided that it can store a program and is readable by the apparatus. The function that is obtained by being installed in advance or downloaded as stated above may be one that cooperates with an OS (Operating System) in the apparatus to implement the desired functionality.

It should be noted that the present invention is not limited to the foregoing embodiments but can be modified in a variety of ways at the embodiment stage without departing from the gist of the invention. Further, the embodiments may be properly combined together as much as possible. In such a case, combined effects can be obtained. Further, the foregoing embodiments include inventions in various stages. Various inventions can be drawn from proper combinations of a plurality of constituent elements disclosed in the embodiments. For example, some constituent elements may be eliminated from all the constituent elements disclosed in an embodiment, provided that it is possible to solve the problems (at least one of them) stated above in the column describing the problems to be solved by the present invention and it is possible to obtain the advantageous effects (at least one of them) mentioned above in the column describing the effects of the present invention. As long as these requirements are met, the arrangement from which some constituent elements are eliminated can be drawn as an invention.

As has been detailed above, it is possible according to the present invention to provide an image forming apparatus that allows easy implementation of options or other extensions to a multi-functional peripheral.

What is claimed is:

1. An image forming apparatus that forms an image by reading an original image, said apparatus comprising:

a storage section that stores at least one function program for function extension in said image forming apparatus;

a restricting section that places usage restrictions on said at least one function program;

a hot-pluggable connecting terminal connectable with a cancellation device that cancels the usage restrictions on said at least one function program;

a detecting section that detects whether or not said cancellation device is connected to said connecting terminal;

a read section that reads cancellation information from said cancellation device when said cancellation device is detected being connected to said connecting terminal by said detecting section;

a cancellation section that cancels the usage restrictions on said at least one function program according to the cancellation information read by said read section; and a control section that controls an operation of equipment relevant to said at least one function program by using said at least one function program released from the usage restrictions by said cancellation section.

2. An image forming apparatus according to claim 1, further comprising:

a display section that displays an extended function of said at least one function program released from the usage restrictions by said cancellation section.

3. An image forming apparatus according to claim 1, further comprising:

a display section that displays whether or not said cancellation device is connected to said connecting terminal.

4. An image forming apparatus according to claim 1, further comprising:

a disabling section that disables usage of said at least one function program released from the usage restrictions by said cancellation section when it is judged that said cancellation device connected to said connecting terminal is disconnected therefrom.

5. An image forming apparatus according to claim 1, wherein said detecting section detects at every predetermined timing whether or not said cancellation device is connected to said connecting terminal.

6. An image forming apparatus according to claim 1, further comprising:

an identification information judging section that judges whether or not to cancel the usage restrictions on said at least one function program on a basis of identification information acquired from said cancellation device.

7. A function extension program for use in an image forming apparatus that instructs a computer of the image forming apparatus to execute reading a predetermined function program from a storage section storing at least one function program on which usage restrictions have previously been placed and enabling the function program, said program instructing the computer to execute:

a detecting step of detecting whether or not a cancellation device that cancels the usage restrictions on said at least one function program is connected to a hot-pluggable connecting terminal;

a read step of reading cancellation information from said cancellation device when said cancellation device is detected being connected to said connecting terminal at said detecting step; and a cancellation step of canceling the usage restrictions on said at least one function program according to the cancellation information read at said read step.

8. A function extension program according to claim 7, which further instructs the computer to execute a control step of controlling an operation of equipment relevant to said at least one function program by using said at least one function program released from the usage restrictions at said cancellation step.

9. A function extension program according to claim 7, which further instructs the computer to execute a display step of displaying an extended function of said at least one function program released from the usage restrictions at said cancellation step.

10. A function extension program according to claim 7, which further instructs the computer to execute a display step of displaying whether or not said cancellation device is connected to said connecting terminal.

11. A function extension program according to claim 7, which has a judging step of judging whether or not said cancellation device connected to said connecting terminal is disconnected therefrom;

said program further instructing the computer to execute a disabling step of disabling usage of said at least one function program released from the usage restrictions at said cancellation step when it is judged that said cancellation device connected to said connecting terminal is disconnected therefrom.

12. A function extension program according to claim 7, wherein said detecting step is executed by the computer at every predetermined timing.

13. A function extension program according to claim 7, which has an identification information judging step of judging whether or not to cancel the usage restrictions on said at least one function program on a basis of identification information acquired from said cancellation device.

14. An image forming apparatus according to claim 1, wherein the hot-pluggable connecting terminal comprises a USB port.

15. A function extension program according to claim 7, wherein the hot-pluggable connecting termial comprises a USB port.

* * * * *